US008781842B2

(12) United States Patent
Taleb

(10) Patent No.: US 8,781,842 B2
(45) Date of Patent: Jul. 15, 2014

(54) SCALABLE CODING WITH NON-CASUAL PREDICTIVE INFORMATION IN AN ENHANCEMENT LAYER

(75) Inventor: Anisse Taleb, Kista (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 1431 days.

(21) Appl. No.: 12/281,953

(22) PCT Filed: Mar. 7, 2007

(86) PCT No.: PCT/SE2007/050132

§ 371 (c)(1),
(2), (4) Date: Sep. 5, 2008

(87) PCT Pub. No.: WO2007/102782

PCT Pub. Date: Sep. 13, 2007

(65) Prior Publication Data

US 2009/0076830 A1 Mar. 19, 2009

Related U.S. Application Data

(60) Provisional application No. 60/743,421, filed on Mar. 7, 2006.

(51) Int. Cl.
*G10L 19/00* (2013.01)
*G10L 19/06* (2013.01)

(52) U.S. Cl.
CPC ..... *G10L 19/06* (2013.01)
USPC ..... 704/500; 704/501

(58) Field of Classification Search
CPC ..... G10L 19/06
USPC ..... 704/200–223, 500–504
See application file for complete search history.

(56) References Cited

U.S. PATENT DOCUMENTS

| | | | | |
|---|---|---|---|---|
| 5,261,027 | A * | 11/1993 | Taniguchi et al. | 704/200 |
| 6,094,636 | A * | 7/2000 | Kim | 704/500 |
| 6,349,284 | B1 * | 2/2002 | Park et al. | 704/500 |
| 6,446,037 | B1 * | 9/2002 | Fielder et al. | 704/229 |
| 6,804,639 | B1 * | 10/2004 | Ehara | 704/223 |
| 7,835,904 | B2 * | 11/2010 | Li et al. | 704/200.1 |
| 2002/0107686 | A1 * | 8/2002 | Unno | 704/219 |
| 2004/0181394 | A1 * | 9/2004 | Kim et al. | 704/200.1 |

(Continued)

OTHER PUBLICATIONS

Gardner et al. "Noncausal All-Pole Modeling of Voiced Speech", IEEE Transactions on Speech and Audio Processing, vol. 5, No. 1, Jan. 1997.*

(Continued)

*Primary Examiner* — Jialong He

(57) ABSTRACT

A method for audio coding and decoding comprises primary encoding of a present audio signal sample into an encoded representation (T(n)), and non-causal encoding of a first previous audio signal sample into an encoded enhancement representation (ET(n−N+)). The method further comprises providing of the encoded representations to an end user. At the end user, the method comprises primary decoding of the encoded representation (T*(n)) into a present received audio signal sample, and non-causal decoding of the encoded enhancement representation (ET*(n−N+)) into an enhancement first previous received audio signal sample. The method further comprises improving of a first previous received audio signal sample, corresponding to the first previous audio signal sample, based on the enhancement first previous received audio signal sample. Devices and systems for audio coding and decoding are also presented.

14 Claims, 9 Drawing Sheets

(56) References Cited

U.S. PATENT DOCUMENTS

| | | | | |
|---|---|---|---|---|
| 2005/0010404 | A1* | 1/2005 | Son et al. | 704/219 |
| 2005/0252361 | A1* | 11/2005 | Oshikiri | 84/605 |
| 2005/0265450 | A1* | 12/2005 | Raveendran et al. | 375/240.15 |
| 2006/0173677 | A1* | 8/2006 | Sato et al. | 704/223 |
| 2007/0271102 | A1* | 11/2007 | Morii | 704/268 |

OTHER PUBLICATIONS

Bettens et al. "Estimation of Vocal Noise in Running Speech by means of Bi-directional Double Linear Prediction", Proc. of Eurospeech, pp. 2377-2380, 2003.*

Chen, Juin-Hwev, et al. A Low-Delay CELP Coder for the CCITT 16 kb/s Speech Coding Standard. IEEE Journal on Selected Areas in Communications. vol. 10: No. 5; pp. 830-849.

L. Marple: "A new autoregressive spectrum analysis algorithm", IEEE Transactions on Acoustics, Speech, and Signal Processing, vol. 28, No. 4, Aug. 1, 1980, XP55000457, ISSN: 0096-3518, 001:10.1109/TASSP.1980.1163429.

T Pukkila: "An improved estimation method for univariate autoregressive models", Journal of Multivariate Analysis, vol. 27, No. 2, Nov. 1, 1988, XP55000513, ISSN: 0047-259X, DOI: 10.1016/0047-259X(88)90139-X.

* cited by examiner

SCALABLE CODING WITH NON-CASUAL PREDICTIVE INFORMATION IN AN ENHANCEMENT LAYER

This application claims the benefit of U.S. Provisional Application No. 60/743,421, filed 2006 Mar. 7, the disclosure of which is fully incorporated herein by reference.

TECHNICAL FIELD

The present invention relates in general to coding and decoding of audio signal samples.

BACKGROUND

In audio signals and in particular in speech signals, there is a high level of correlation between adjacent samples. In order to perform an efficient quantization and encoding of speech signals, such redundancy can be removed prior to encoding.

Speech signals can be efficiently modeled with two slowly time-varying linear prediction filters that model the spectral envelope and the spectral fine structure respectively. The shape of the vocal tract mainly determines the short-time spectral envelope, while the spectral fine structure is mainly due to the periodic vibrations of the vocal cord.

In prior art redundancy in audio signals are often modeled using linear models. A well-known technique for removal of redundancy is through the use of prediction and in particular linear prediction. An original present audio signal sample is predicted from previous audio signal samples, either original ones or predicted ones. A residual is defined as the difference between the original audio signal sample and the predicted audio signal sample. A quantizer searches for a best representation of the residual, e.g. an index pointing to an internal codebook. The representation of the residual and parameters of the linear prediction filter are provided as representations of the original present audio signal sample. In the decoder, the representation can be then used for recreating a received version of the present audio signal sample.

Linear prediction is often used for short-term correlations. In theory, the LP filter could be used at any order. However, usage of large order linear prediction is strongly inadvisable due to numerical stability problems of the Levinson-Durbin algorithm as well as the resulting amount of complexity in terms of memory storage and arithmetical operations. Moreover, the required bit-rate for encoding the LP coefficients prohibits such use. The order of the LP predictors used in practice does not, in general, exceed 20 coefficients. For instance, a standard for wideband speech coding AMR-WB has an LPC filter of order 16.

In order to further reduce the required amount of bit-rate while maintaining the quality, there is a need to properly exploit the periodicity of speech signals in voiced speech segments. To this end, and because linear prediction would in general exploit correlations which are contained in less than a pitch cycle, a pitch predictor is often used on the linear prediction residual. Long-term dependencies in audio signals can thereby be exploited.

Although currently standardized speech codecs deliver an acceptable quality at very low bit-rates, it is believed that the quality may be further enhanced at the cost of very few extra bits. One minor problem with prior-art speech and audio coding algorithms is that the prior art model for speech or audio signals, although being very efficient, does not take into account all the possible redundancies that are present in audio signals. In general audio coding, and in particular in speech coding, there is always a need to lower the needed bit-rate at a given quality or to get a better quality at a given bit-rate.

Furthermore, embedded or layered approaches are today often requested in order to adapt the relation between quality and bit-rate. However, at a given bit-rate, and for a given coding structure, an embedded or layered speech coder will often show a loss in quality when compared to a non-layered coder. In order to experience the same quality with the same coding structure it is often required that the bit-rate is increased.

SUMMARY

An object of the present invention is to further utilize redundancies present in audio signals. A further object of the present invention is to provide an encoding-decoding scheme which is easily applied in an embedded or layered approach. Yet a further object of the present invention is to provide further redundancy utilization without causing too large delays.

The above objects are achieved by methods and devices according to the enclosed claims. In general words, in a first aspect, a method for audio coding and decoding comprises primary encoding of a present audio signal sample into an encoded representation of the present audio signal sample, and non-causal encoding of a first previous audio signal sample into an encoded enhancement representation of the first previous audio signal sample. The method further comprises providing of the encoded representation of the present audio signal sample and the encoded enhancement representation of the first previous audio signal sample to an end user. At the end user, the method comprises primary decoding of the encoded representation of the present audio signal sample into a present received audio signal sample, and non-causal decoding of the encoded enhancement representation of the first previous audio signal sample into an enhancement first previous received audio signal sample. The method further comprises improving of a first previous received audio signal sample, corresponding to the first previous audio signal sample, based on the first previous received audio signal sample and the enhancement first previous received audio signal sample.

In a second aspect, a method for audio coding comprises primary encoding of a present audio signal sample into an encoded representation of the present audio signal sample and non-causal encoding of a first previous audio signal sample into an encoded enhancement representation of the first previous audio signal sample. The method further comprises providing of the encoded representation of the present audio signal sample and the encoded enhancement representation of the first previous audio signal sample.

In a third aspect, a method for audio decoding comprises obtaining of an encoded representation of a present audio signal sample and an encoded enhancement representation of a first previous audio signal sample at an end user. The method further comprises primary decoding of the encoded representation of the present audio signal sample into a present received audio signal sample, and non-causal decoding of the encoded enhancement representation of the first previous audio signal sample into an enhancement first previous received audio signal sample. The method also comprises improving of a first previous received audio signal sample, corresponding to the first previous audio signal sample, based on the first previous received audio signal sample and the enhancement first previous received audio signal sample.

In a fourth aspect, an encoder for audio signal samples comprises an input for receiving audio signal samples, a primary encoder section, connected to the input and arranged for encoding a present audio signal sample into an encoded representation of the present audio signal sample as well as a non-causal encoder section, connected to the input and arranged for encoding a first previous audio signal sample into an encoded enhancement representation of the first previous audio signal sample. The encoder further comprises an output, connected to the primary encoder section and the non-causal encoder section and arranged for providing the encoded representation of the present audio signal sample and the encoded enhancement representation of the first previous audio signal sample.

In a fifth aspect, a decoder for audio signal samples comprises an input, arranged for receiving an encoded representation of a present audio signal sample, encoded by a primary encoder, and an encoded enhancement representation of a first previous audio signal sample, encoded by a non-causal encoder. The decoder further comprises a primary decoder section, connected to the input and arranged for primary decoding of the encoded representation of the present audio signal sample into a present received audio signal sample, and a non-causal decoder section, connected to the input and arranged for non-causal decoding of the encoded enhancement representation of the first previous audio signal sample into an enhancement first previous received audio signal sample. The decoder also comprises a signal conditioner, connected to the primary decoder section and the non-causal decoder section and arranged for improving a first previous received audio signal sample, corresponding to the first previous audio signal sample, based on a comparison between the first previous received audio signal sample and the enhancement first previous received audio signal sample.

In a sixth aspect, a terminal of an audio mediating system comprises at least one of an encoder according to the fourth aspect and a decoder according to the fifth aspect.

In a seventh aspect, an audio system comprises at least one terminal having an encoder according to the fourth aspect and at least one terminal having a decoder according to the fifth aspect.

The invention allows an efficient use of prediction principles in order to reduce the redundancy that is present in speech signals and in general audio signals. This results in an increase in coding efficiency and quality without unacceptable delays. The invention also enables embedded coding by using generalized prediction.

BRIEF DESCRIPTION OF THE DRAWINGS

The invention, together with further objects and advantages thereof, may best be understood by making reference to the following description taken together with the accompanying drawings, in which.

DETAILED DESCRIPTION

In the present disclosure, audio signals are discussed. It is then assumed that the audio signals are provided in consecutive signal samples, associated with a certain time.

Figure 1A:
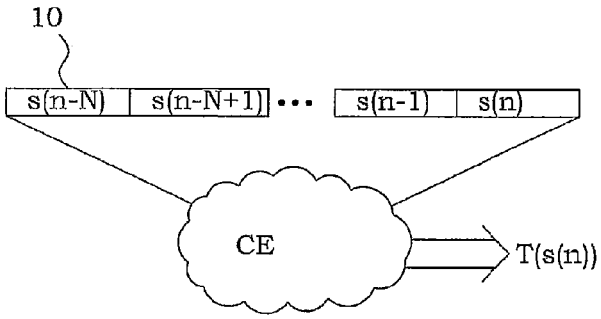
Fig. 1A PRIOR ART
FIG. 1A is a schematic illustration of causal encoding.

When coding audio signal samples using prediction models, relations between consecutive signal samples are utilized for removing redundant information. A simple sketch is shown in FIG. 1A, illustrating a set of signal samples 10, each one associated with a certain time. An encoding of a present signal sample s(n) is produced based on the present signal sample s(n) as well as a number of previous signal samples s(n−N), . . . s(n−1), original or representations thereof. Such an encoding is denoted a causal encoding CE, since it refers to information available before the time instant of the present signal sample s(n) to be encoded. Parameters T describing the causal encoding CE of signal sample s(n) are then transferred for storage and/or end usage.

Figure 1B:
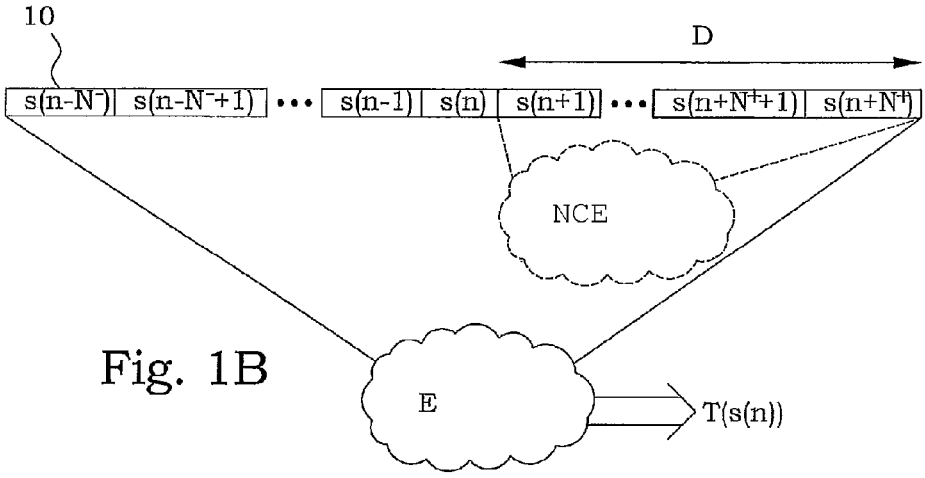
FIG. 1B is a schematic illustration of encoding using past and future signal samples.

There is also a relation between a present signal sample and future signal samples. Such relations can also be utilized in order to remove redundancies. In FIG. 1B, a simple sketch illustrates these dependencies. In a general case, an encoding of a signal sample s(n) at time n is made, based on the present signal sample s(n), signal samples s(n−1), . . . , s(n−$N^-$) or representations thereof associated with times before time n as well as on signal samples s(n+1), . . . , s(n+$N^+$) or representations thereof associated with times after time n. An encoding referring to information available only after the time instant of the signal sample to be encoded is denoted a non-causal encoding NCE. In other descriptions, in case prediction encoding is applied, the terms postdiction and retrodiction are also used.

The encoding of the signal sample at time n in FIG. 1B is in general more likely to be better than the encoding provided in FIG. 1A, since more relations between different signal samples are utilized. However, the main disadvantage of a system as illustrated in FIG. 1B is that the encoding is only available after a certain delay D in time, corresponding to $N^+$ signal samples, in order to incorporate information from the later signal samples as well. Also, when decoding signal samples using non-causal encoding, an additional delay is introduced, since also here, "future" signal samples have to be collected. In general this approach is impossible to realize since in order to decode a signal sample both past and future decoded signal samples need to be available.

Figure 1C:
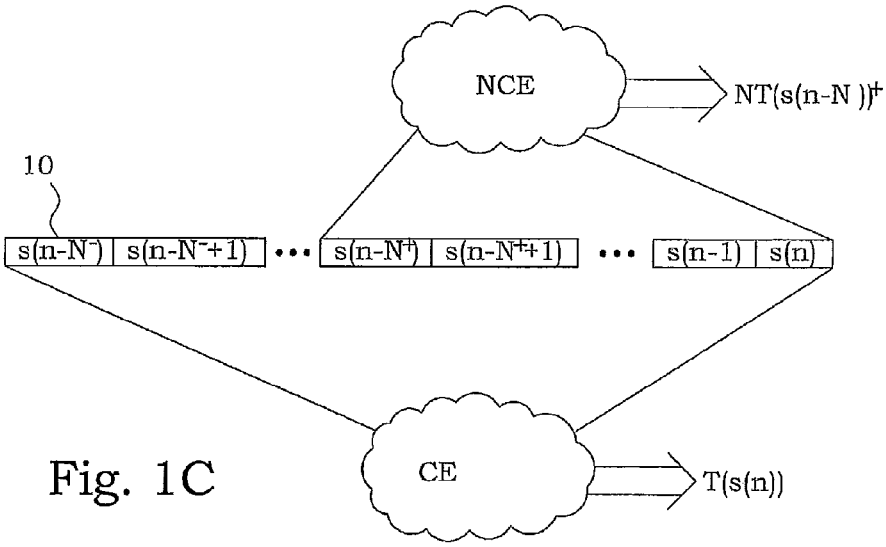
FIG. 1C is a schematic illustration of causal and non-causal encoding according to the present invention.

According to the present invention, another non-causal approach is presented, illustrated schematically in FIG. 1C. Here, a causal encoding CE, basically according to prior art is first provided, giving parameters P of an encoded signal sample s(n) and eventually a decoded signal dependent thereon. At the same time, an additional non-causal encoding NCE is provided for a previous signal sample $s(n-N^{+})$, resulting in parameters NT. This additional non-causal encoding NCE can be utilized for an upgrading or enhancement of the previous decoded signal, if time and signaling resources so admits. If such a delay is unacceptable, the additional non-causal encoding NCE can be neglected. If an upgrading of the decoded signal sample is made, a delay is indeed introduced. Besides the fact that this approach is possible to realize, one notices also that the delay is reduced by half in relation to the coding scheme of FIG. 1B, since all necessary signal samples indeed are available at the decoder when the non-causal encoding arrives. This basic idea will be further described and discussed in a number of embodiments here below.

The encoding schemes, causal as well as non-causal, used with the present ideas can be of almost any kind utilizing redundancies between consecutive signal samples. Non-exclusive examples are Transform coding and CELP coding. The encoding schemes of the causal and the non-causal encoding may not necessarily be of the same kind, but in some cases, additional advantages may occur if both encodings are made according to similar schemes. However, in the following embodiments, prediction encoding schemes are used as a model example of an encoding scheme. Prediction encoding schemes are also presently considered as a preferable schemes to be used in the present invention.

To this end, before going into the particulars of the present invention, first a somewhat deeper description of prior art causal prediction coding is presented, to provide a scientific foundation.

Two types of causal prediction models for redundancy removal can be distinguished. The first is a so-called open-loop causal prediction, which is based on original audio signal samples. The second is a closed-loop causal prediction and is based on predicted and reconstructed audio signal samples, i.e. representations of the original audio signal samples.

Figure 2A:
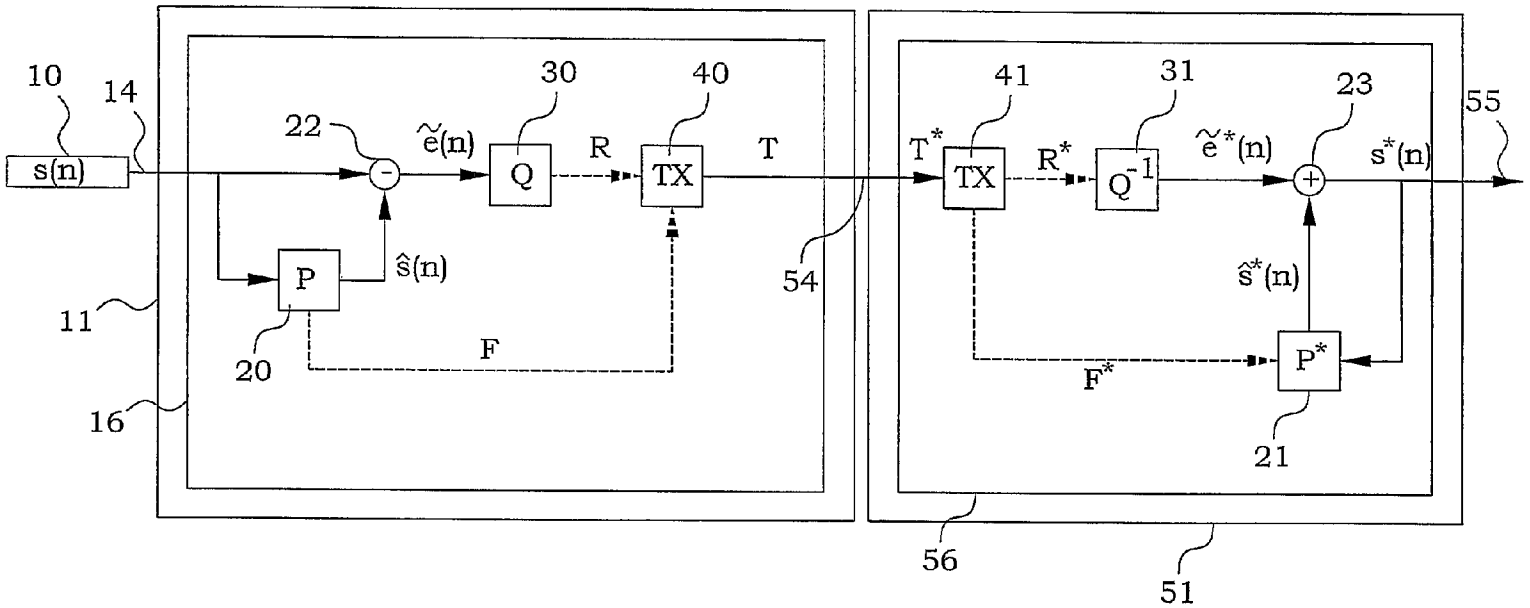
PRIOR ART Fig. 2A
FIG. 2A is a block scheme illustrating open-loop prediction encoding.

A speech codec based on a redundancy removal process with an open-loop causal prediction can be roughly seen as represented in FIG. 2A as a block diagram of a typical prediction based coder and decoder. Considerations about perceptual weighting are neglected in the present presentation in order to simplify the basic understanding and are therefore not shown.

As a general setting for an open-loop prediction, an original present audio signal sample s(n) provided to an input 14 of a causal prediction encoder section 16 of an encoder 11 is predicted in a predictor 20 from previous original audio signal samples s(n−1), s(n−2), . . . , s(n−N) by using a relation:

$$\hat{s}(n)=P(s(n-1),s(n-2),\ldots,s(n-N)). \tag{1}$$

Here ŝ(n) denotes an open-loop prediction for s(n), while P(•) is a causal predictor and N is a prediction order. An open-loop residual ẽ(n) is defined in a calculating means, here a subtractor 22 as:

$$\tilde{e}(n)=s(n)-\hat{s}(n). \tag{2}$$

An encoding means, here a quantizer 30 would search for a best representation R of ẽ(n). Typically, an index of such representation R points to an internal codebook. The representation R and parameters F characterizing the predictor 20 are provided to a transmitter (TX) 40 and encoded into an encoded representation T of the present audio signal sample s(n). The encoded representation T is either stored for future use or transferred to an end user.

A received version of the encoded representation T* of the present audio signal sample s(n) is received by an input 54 into a receiver (RX) 41 of a causal prediction decoder section 56 of a decoder 51. In the receiver 41, the encoded representation T* is decoded into a received representation R* of a received residual ẽ*(n) signal and into received parameters F* for a decoder predictor 21. Ideally, the encoded representation T*, the received representation R* of the received residual $\bar{e}^*(n)$ signal and the received parameters F* are equal to corresponding quantities in the encoder. However, transmission errors may be present, introducing minor errors in the received data. A decoding means, here a dequantizer 31 of the causal prediction decoder section 56 provides a received open-loop residual $\bar{e}^*(n)$. Typically, the internal codebook index is received and the corresponding codebook entry is used. The decoder predictor 21 is initiated by the parameters F* for providing a prediction ŝ(n)* based on previous received audio signal samples $\bar{s}^*(n-1), \bar{s}^*(n-2), \ldots, \bar{s}^*(n-N)$:

$$\hat{s}^*(n)=P(\bar{s}^*(n-1),\bar{s}^*(n-2),\ldots,\bar{s}^*(n-N)). \tag{3}$$

A present received audio signal sample $\bar{s}^*(n)$ is then calculated in a calculating means, here an adder 23 as:

$$\bar{s}^*(n)=\hat{s}^*(n)+\bar{e}^*(n). \tag{4}$$

The present received audio signal sample $\bar{s}^*(n)$ is provided to the decoder predictor 21 for future use and as an output signal of an output 55 of the decoder 51.

Figure 2B:
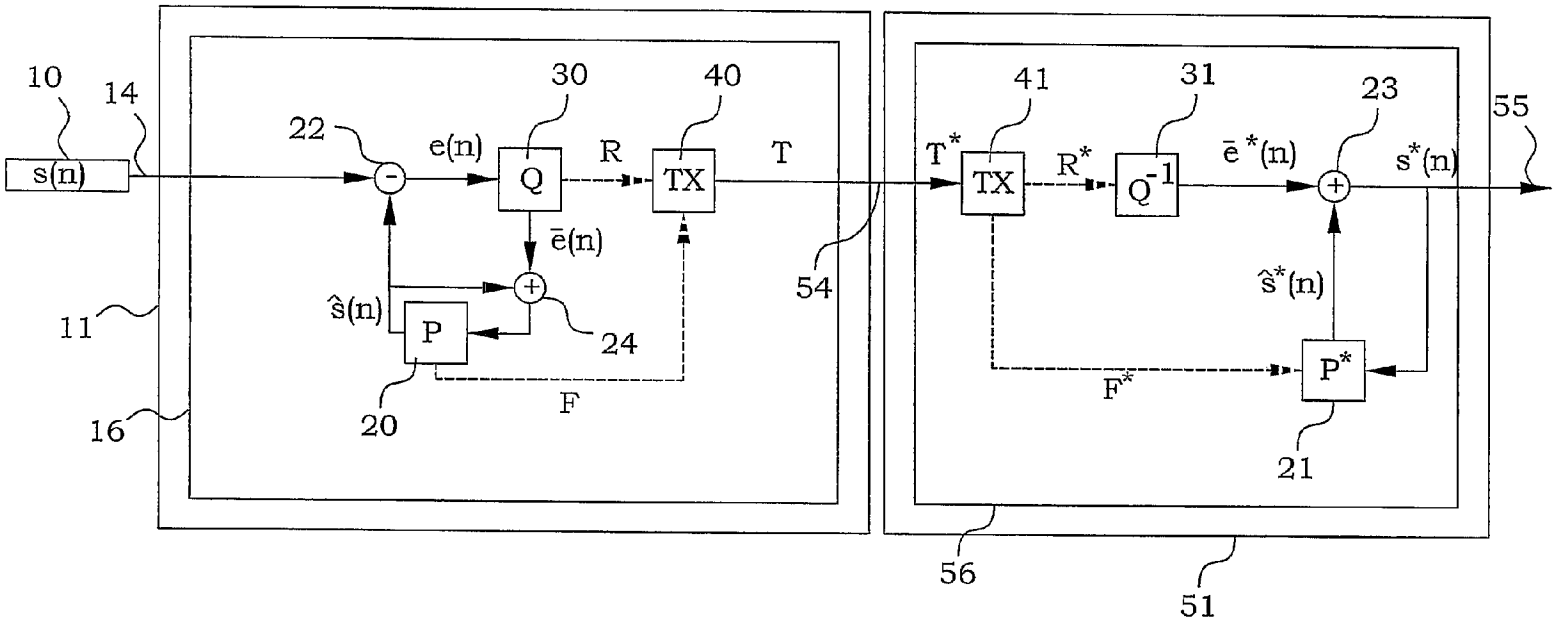
PRIOR ART Fig. 2B
FIG. 2B is a block scheme illustrating closed-loop prediction encoding.

Analogously, a speech codec based on a redundancy removal process with a closed-loop causal prediction can be roughly seen as represented in FIG. 2B as a block diagram of a typical prediction based coder and decoder. The closed loop residual signal can be defined as the one obtained when the prediction uses reconstructed audio signal samples, here denoted as $\bar{s}(n-1), \bar{s}(n-2), \ldots, \bar{s}(n-N)$, instead of the original audio signal samples. The closed loop prediction would in this case be written as:

$$\hat{s}(n)=P(\bar{s}(n-1),\bar{s}(n-2),\ldots,\bar{s}(n-N)), \tag{5}$$

and the closed loop residual as:

$$e(n)=s(n)-\hat{s}(n). \tag{6}$$

From the representation R of e(n), a decoded residual $\bar{e}(n)$ is regained, which is added to the closed loop prediction ŝ(n) in an adder 24 in order to provide the predictor 20 with a reconstructed audio signal sample $\bar{s}(n)$ for use in future predictions. The reconstructed audio signal sample $\bar{s}(n)$ is thus a representation of the original audio signal sample s(n).

At the receiver side, the decoding process is the same as presented in FIG. 2A.

Equations (1), (3) and (5) use a generic predictor, which in a general case may be non-linear. Prior art linear prediction, i.e. estimations using a linear predictor, is often used as means for redundancy reduction in speech and audio codecs. For such case, the predictor P(•), is written as a linear function of its arguments. Equation (5) then becomes:

$$\begin{aligned}\hat{s}(n) &= P(\bar{s}(n-1), \bar{s}(n-2), \ldots, \bar{s}(n-N)) \\ &= \sum_{i=1}^{N} a_i \bar{s}(n-i).\end{aligned} \tag{7}$$

The coefficients $a_1, a_2, \ldots, a_L$ are called linear prediction (LP) coefficients. Most modern speech or audio codecs use time varying LP coefficients in order to adapt to the time varying nature of audio signals. The LP coefficients are easily estimated by the applying e.g. the Levinson-Durbin algorithm on the autocorrelation sequence, the latter is estimated on a frame-by-frame basis.

Linear prediction is often used for short-term correlations, the order of the LP predictor does not, in general, exceed 20 coefficients. For instance, the standard for wideband speech coding AMR-WB has an LPC filter of order 16.

In theory, the LP filter could be used at any order. However, this usage is strongly inadvisable due to numerical stability of the Levinson-Durbin algorithm as well as the resulting amount of complexity in terms of memory storage and arithmetical operations. Moreover, the required bit-rate for encoding the LP coefficients prohibits such use.

In order to further reduce the required amount of bit-rate while maintaining the quality, there is a need to properly exploit the periodicity of speech signals in voiced speech segments. To this end, and because linear prediction would in general exploit correlations which are contained in less than a pitch cycle, a pitch predictor is typically used on the linear prediction residual. Two different approaches are known and have been often used in order to exploit long-term dependencies in speech signals.

A first approach is based on an adaptive codebook paradigm. The adaptive codebook contains overlapping segments of the recent past of the LP excitation signal. Using this approach, a linear prediction analysis-by-synthesis coder will typically encode the excitation using both an adaptive codebook contribution and a fixed codebook contribution.

A second approach is more direct in the sense that the periodicity is removed from the excitation signal by means of closed loop long-term prediction and the reminder signal is then encoded using a fixed codebook.

Figure 3:
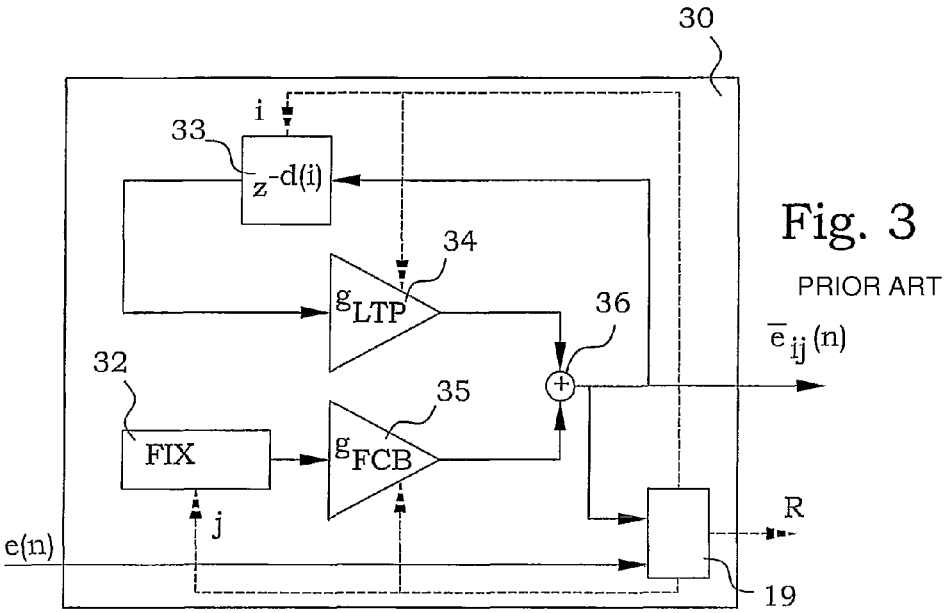
Fig. 3 PRIOR ART
FIG. 3 is a block scheme illustrating adaptive codebook encoding.

Both approaches are in fact quite similar both conceptually and in terms of implementation. FIG. 3 illustrates excitation generation, e.g. as provided by a quantizer 30 (FIGS. 2A&B), using adaptive 33 and fixed 32 codebook contributions. In the adaptive codebook approach, the excitation signal is derived in an adder 36 as a weighted sum of two components:

$$\bar{e}_{ij}(n)=g_{LTP}c_{LTP}^{i}(n)+g_{FCB}c_{FCB}^{j}(n) \tag{8}$$

The variables $g_{LTP}$ 34 and $g_{FCB}$ 35 denote adaptive codebook and fixed codebook gains, respectively. Index j denotes a fixed codebook 32 entry. The index i denotes the adaptive codebook 33 index. This adaptive codebook 33 consists of entries which are previous segments of recently synthesized excitation signals:

$$c_{LTP}^{i}(n)=\bar{e}(n-d(i)) \tag{9}$$

The delay function d(i) specifies the start of the adaptive codebook vector. For complexity reasons, the determination of gains and indices is typically done in a sequential manner. First, the adaptive codebook contribution is found, i.e. the corresponding index as well as the gain. Then, after subtraction from the target excitation signal, or weighted speech, depending on the specific implementation, the contribution of the fixed codebook is found.

An optimum set of codebook parameters is found by comparing the residual signal e(n) to be quantized with $\bar{e}(n)$ in an optimizer 19. A best representation R of a residual signal will in such a case typically comprise $g_{LTP}$, $g_{FCB}$, $c_{FCB}^{j}$ and the delay function d(i).

The adaptive codebook paradigm has also a filter interpretation, where a pitch predictor filter is used and which commonly writes as:

$$\frac{1}{P(z)}=\frac{1}{1-g_{LTP}z^{-d(i)}} \tag{10}$$

Several variations of the same concept also exists, such as when the delay function not limited to integer pitch delays, but can also contain fraction delays. Another variation is the multi-tap pitch prediction, which is quite similar to the fractional pitch delay since both approaches use multi-tap filters. Additionally, these two approaches produce very similar results. In general, a pitch predictor of order 2q+1 is given by:

$$P(z)=1-\sum_{k=-q}^{q} b_k z^{-D+k} \tag{11}$$

Several state-of-the-art standardized codecs use the previously described structure for speech coding. Notorious examples include the 3GPP AMR-NB and 3GPP AMR-WB codecs. In addition, the ACELP part of the hybrid structure of the AMR-WB+ uses also such structure for efficient encoding of both speech and audio.

In general, the integer pitch delay is estimated in open loop such that the squared error between the original signal and its predicted value is minimized. The original signal is here taken in a wide sense such that weighting can also be used. An exhaustive search is used in the allowed pitch ranges (2 to 20 ms).

An important concept of the present invention is the use of non-causal encoding, and in a preferred embodiment non-causal prediction encoding, as means for redundancy reduction and as means for encoding. Non-causal prediction may also be referred to as reverse time prediction. Non-causal prediction can be both linear and non-linear. When linear prediction is used, non-causal prediction comprises for instance non-causal pitch prediction but can also be represented by non-causal short-term linear prediction. In simpler terms, the future of the signal is used to form a prediction of the current signal. However, since the future is usually unavailable at the time of encoding, a delay is often used in order to have access to the future samples of the signal. The non-causal prediction then becomes a prediction of a previous signal based on a present signal and/or other previous signals occurring after the one to be predicted.

In a general setting for non-causal prediction, an original speech signal sample s(n), or in general an audio signal sample or even any signal sample, is predicted from future signal samples s(n+1), s(n+2), . . . , s(n+$N^+$) by using $$\hat{s}^{+}(n)=P^{+}(s(n+1),s(n+2),\ldots,s(n+N^{+})) \tag{12}$$

here $\hat{s}^{+}(n)$ denotes the non-causal open-loop prediction for s(n). The super-script (+) is used in this case as to differentiate it from the "normal" open-loop prediction, and which is rewritten here for the sake of completeness using the super-script (−);

$$\hat{s}^{-}(n)=P^{-}(s(n-1),s(n-2),\ldots,s(n-N^{-})) \tag{13}$$

The causal and non-causal predictors are denoted by $P^{+}(\bullet)$ and $P^{-}(\bullet)$ and the predictor orders are respectively denoted, $N^{-}$ and $N^{+}$ In the same way, open-loop residuals may be defined as $$\tilde{e}^{+}(n)=s(n)-\hat{s}^{+}(n)$$

$$\tilde{e}^{-}(n)=s(n)-\hat{s}^{-}(n) \tag{14}$$

The closed loop residuals can also be defined similarly. For the case of causal prediction, such definition is exactly the same as the one given further above. However, for non-causal prediction, and since a coder is essentially a causal process, albeit with a certain delay, such definition is impossible using predictions caused by the same non-causal prediction, even by using additional delay. In fact, the coder uses non-causal prediction in order to encode samples, which would depend on future encoding. One observes therefore, that non-causal prediction cannot be used directly as means for encoding or redundancy reduction, unless we flip the arrow of time, but in that case, it would become causal prediction with a reversed time speech.

Non-causal prediction can, however, be efficiently used in closed loop, however, in an indirect way. One such embodiment is to primarily encode the signal with the causal predictor $P^-(\bullet)$ and thereafter use the non-causal predictor $P^+(\bullet)$ in a backward closed-loop fashion based on the signals predicted by the causal predictor $P^-(\bullet)$.

Figure 4:
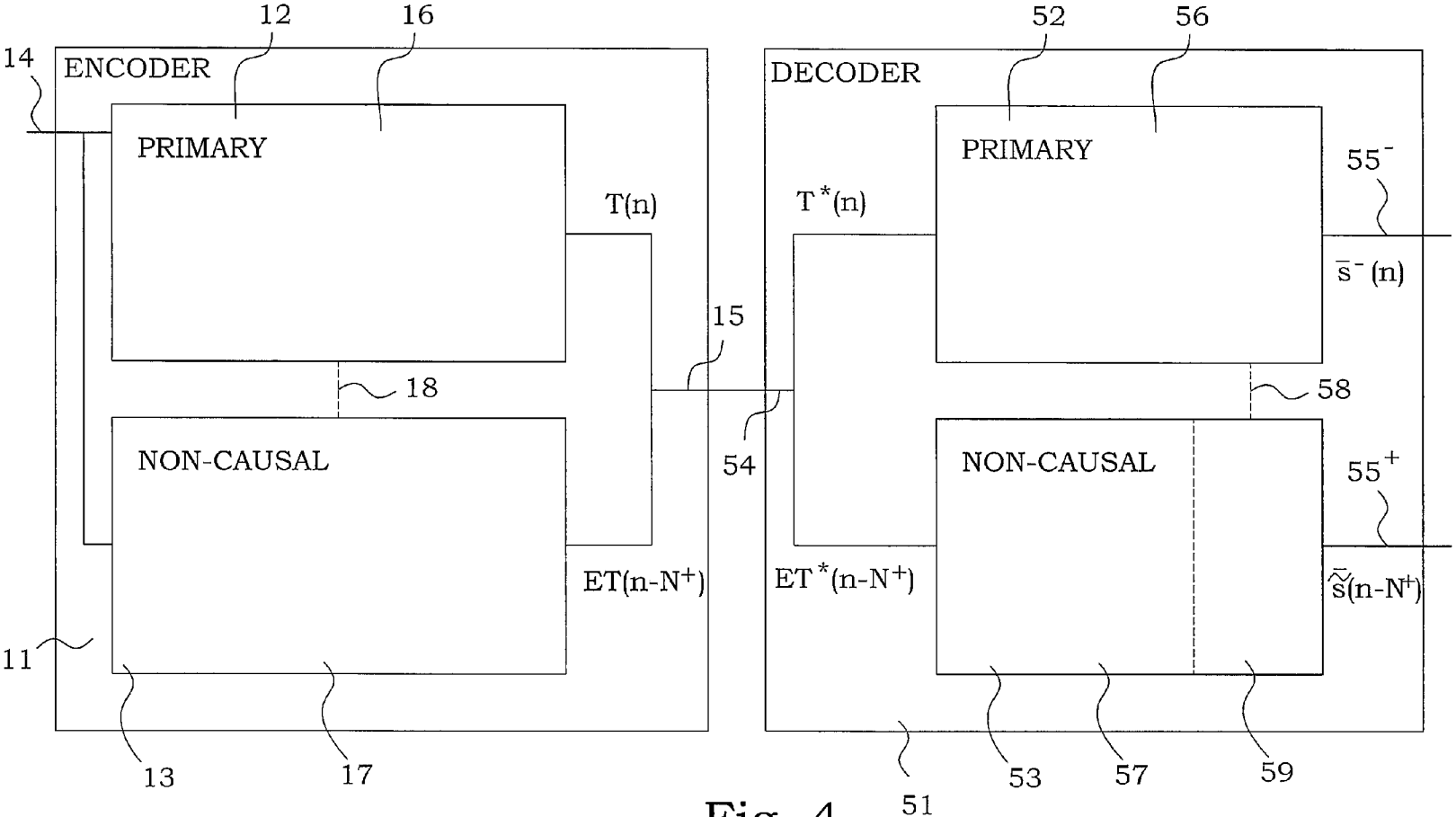
FIG. 4 is a block scheme of an embodiment of an arrangement of an encoder and a decoder according to the present invention.

In FIG. 4, an embodiment of non-causal encoding applied to speech or audio coding is illustrated. A combination of a primary encoder and a non-causal prediction is used as means for encoding and redundancy reduction. In the present embodiment non-causal prediction encoding is utilized and a causal prediction encoding is utilized as primary encoding. An encoder 11 receives signal samples 10 at an input 14. A primary encoding section, here a causal encoding section 12, particularly in this embodiment a causal prediction encoding section 16 receives the present signal sample 10 and produces an encoded representation T of the present audio signal sample s(n), which is provided at an output 15. The present signal sample 10 is also provided to a non-causal encoding section 13, in this embodiment a non-causal prediction encoding section 17. The non-causal prediction encoding section 17 provides an encoded enhancement representation ET of a previous audio signal sample $s(n-N^+)$ on the output 15. The non-causal prediction encoding section 17 may base its operation also on information 18 provided from the causal prediction encoding section 16.

In a decoder 51, an encoded representation T* of the present audio signal sample s(n) as well as an encoded enhancement representation ET* of a previous audio signal sample $s(n-N^+)$ are received at an input 54. The received encoded representation T* is provided to a primary causal decoding section, here a causal decoding section 52, and particularly in this embodiment a causal prediction decoding section 56. The causal prediction decoding section 56 provides a present received audio signal sample $\bar{s}^-(n)$ 55$^-$. The encoded enhancement representation ET* is provided to a non-causal decoding section 53, in this embodiment a non-causal prediction decoding section 57. The non-causal prediction decoding section 57 provides an enhancement previous received audio signal sample. A previous received audio signal sample $\bar{s}^*(n-N^+)$ is enhanced in a signal conditioner 59, which can be a part of the non-causal prediction decoding section 57 or a separate section, based on enhancement previous received audio signal sample. The enhanced previous received audio signal sample $\tilde{\bar{s}}(n-N^+)$ is provided at an output 55$^+$ of the decoder 51.

Figure 5:
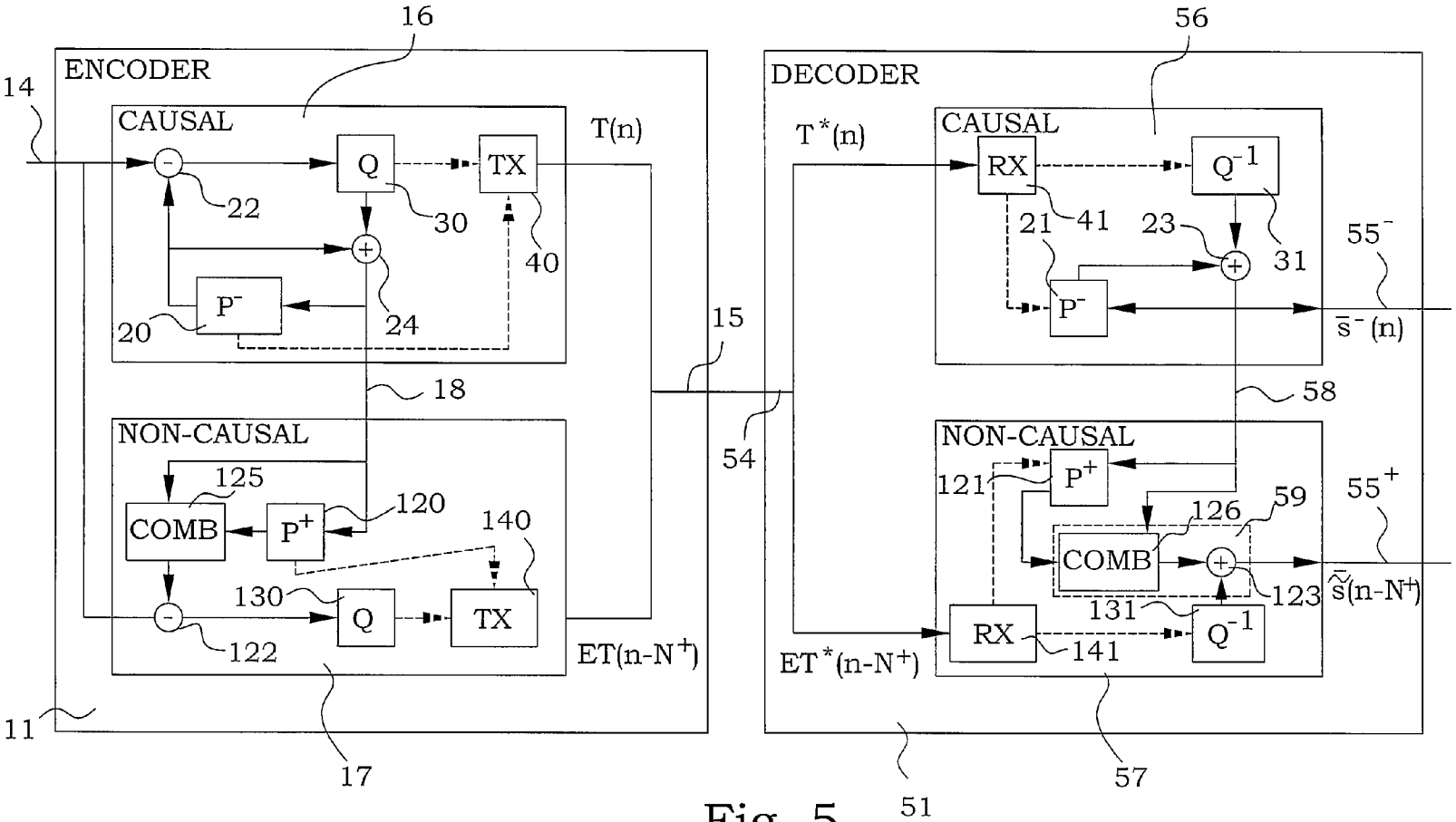
FIG. 5 is a block scheme of an embodiment of an arrangement of a prediction encoder and a prediction decoder according to the present invention.

In FIG. 5, a further detailed embodiment of non-causal closed-loop prediction applied to audio coding is illustrated. The causal predictor parts are easily recognized from FIG. 2B. In FIG. 5, however, it is shown how a non-causal predictor 120 uses future samples of a primary encoded speech signal 18. Corresponding samples 58 are also available in the decoder 51 for the non-causal predictor 121. Of course a delay is to be applied in order to access these samples.

An additional "combine" function is also introduced by a combiner 125. The function of the combiner 125 consists of combining the primarily encoded signal, i.e. $\bar{s}^-(n-N^+)$, based on the closed-loop causal prediction, with the output of the non-causal predictor that is dependent on later samples of $\bar{s}^-(n)$, i.e.

$$\hat{s}^+(n-N^+)=P^+(\bar{s}^-(n-N^++1),\bar{s}^-(n-N^++2),\ldots,\bar{s}^-(n)) \tag{15}$$

This combination could be linear or non-linear. The output of this module can be written as $$\tilde{s}(n-N^+)=C(\hat{s}^+(n-N^+),\bar{s}^-(n-N^+)) \tag{16}$$

Preferably, the combination function C(•) is chosen such as to minimize the resulting error between the combination signal, $\tilde{s}(n-N^+)$ and the original speech signal $s(n-N^+)$, provided by a calculating means, here the subtractor 122 and defined as:

$$\tilde{e}(n-N^+)=s(n-N^+)-\tilde{s}(n-N^+). \tag{17}$$

Error minimization is here as usual understood in a wide sense with respect to some predetermined fidelity criterion, such as mean squared error (MSE) or weighted mean squared error (wMSE), etc. This resulting error residual is quantized in an encoding means, here a quantizer 130, providing encoded enhancement representation ET of the audio signal sample $s(n-N^+)$.

The resulting error, could also be quantized such that the resulting speech signal, $$\tilde{\bar{s}}(n-N^+)=\tilde{\bar{e}}(n-N^+)+\tilde{s}(n-N^+) \tag{18}$$

is as close as possible to the original speech signal with respect to the said predetermined fidelity criterion.

Finally, one should note that the predictors $P^-(\bullet)$ 20 and $P^+(\bullet)$ 120 as well as the combine function C(•) 125 may be time varying and chosen to follow the time-varying characteristics of the original speech signal and/or to be optimal with respect to a fidelity criterion. Therefore, time varying parameters steering these functions, have also to be encoded and transmitted by a transmitter 140. Upon reception in the decoder, these parameters are used in order to enable decoding.

At the decoder side the non-causal prediction decoding section 57 receives the encoded enhancement representation ET* in a receiver 141, and decodes it by decoding means, here a dequantizer 131 into a residual sample signal. Other parameters of the encoded enhancement representation ET* are used for a non-causal decoder predictor 121 to produce a predicted enhancement signal sample. This predicted enhancement signal sample is combined with the primary predicted signal sample in a combiner 126 and added to the residual signal in a calculating means, here an adder 123. The combiner 126 and the adder 123 here together constitutes the signal conditioner 59.

Linear prediction has lower complexity and is simpler to use than general non-linear prediction. Moreover, it is common knowledge that linear prediction is more than sufficient as a model for speech signal production.

In the previous sections, the predictors $P^-(\bullet)$ and $P^+(\bullet)$ as well as the combine function C(•) were assumed to be general. In practice, a simple linear model is often used for these functions. The predictors become linear filters, similar to Eq. (7), while the combination function becomes a weighted sum.

In theory, if the signal is stationary and both predictors use the same order, then the causal and non-causal predictors when estimated in open loop using the same window will lead to the same set of coefficients. The reason is that the linear predictive filter is linear phase and hence both forward and backward prediction errors have the same energy. This in fact is used by low delay speech codecs in order to derive LPC filter coefficients from past decoded speech signal, e.g. LD-CELP.

In contrast to backward linear prediction, non-causal linear prediction, would in the general case, re-estimate a new "backward predictive" filter to be applied on the same set of decoded speech samples, thus taking into account the spectral changes that occur during the first "primary" encoding. Moreover, the non-stationarity of the signal is correctly taken into account in the second pass, at the enhancement coder.

The present invention is well-adapted for layered speech coding. First a short review of prior-art layered coding is given.

Scalability in speech coding is achieved through the same axes as generic audio coding: Bandwidth, Signal-to-Noise Ratio and spatial (multiple number of channels). However since speech compression is mainly used for conversational communication purposes where multi-channel operation is still quite uncommon most interest with respect to speech coding scalability has been focused on SNR and audio bandwidth scalability. SNR scalability has always been the major focus in legacy switched networks that always are interconnected to the fixed bandwidth 8 kHz PSTN. This SNR scalability found its use in handling temporary congestion situations, e.g. in deployment-costly and relatively low bandwidth Atlantic communications cables. Recently with the emerging availability of high-end terminals, supporting higher sampling rates, bandwidth scalability has become a realistic possibility.

The most used scalable speech compression algorithm today is the 64 kbps G.711 A/U-law logarithmic PCM codec. The 8 kHz sampled G.711 codec converts 12 bit or 13 bit linear PCM samples to 8 bit logarithmic samples. The ordered bit representation of the logarithmic samples allows for stealing the Least Significant Bits (LSBs) in a G.711 bit stream, making the G.711 coder practically SNR-scalable between 48, 56 and 64 kbps. This scalability property of the G.711 codec is used in the Circuit Switched Communication Networks for in-band control-signaling purposes. A recent example of use of this G.711 scaling property is the 3GPP-TFO protocol that enables Wideband Speech setup and transport over legacy 64 kbps PCM links. Eight kbps of the original 64 kbps G.711 stream is used initially to allow for a call setup of the wideband speech service without affecting the narrowband service quality considerably. After call setup the wideband speech will use 16 kbps of the 64 kbps G.711 stream. Other older speech coding standards supporting open-loop scalability are G.727 (embedded ADPCM) and to some extent G.722 (sub-band ADPCM).

A more recent advance in scalable speech coding technology is the MPEG-4 standard that provides scalability extensions for MPEG4-CELP both in the SNR domain and in the bandwidth domain. The MPE base layer may be enhanced by transmission of additional filter parameters information or additional innovation parameter information. In the MPEG4-CELP concept enhancement layers of type "BRSEL" are SNR-increasing layers for a selected base layer, "BWSEL"-layers are bandwidth enhancing layers making it possible to provide an 16 kHz output. The result is a very flexible encoding scheme with a bit rate range from 3.85 to 23.8 kbps in discrete steps. The MPEG-4 speech coder verification tests do however show that the additional flexibility that scalability enables comes at a cost compared to fixed multimode (non-scalable) operation.

The International Telecommunications Union-Standardization Sector, ITU-T has recently ended the qualification period for a new scalable codec nicknamed as G.729.EV. The bit rate range of this future scalable speech codec will be from 8 kbps to 32 kbps. The codec will provide narrowband SNR scalability from 8-12 kbps, bandwidth scalability from 12-14 kbps, and SNR scalability in steps of 2 kbps from 14 kbps and up to 32 kbps The major use-case for this codec is to allow efficient sharing of a limited bandwidth resource in home or office gateways, e.g. a shared xDSL 64/128 kbps uplink between several VoIP calls. Additionally the 8 kbps core will be interoperable with existing G.729 VoIP-terminals.

Figure 10:
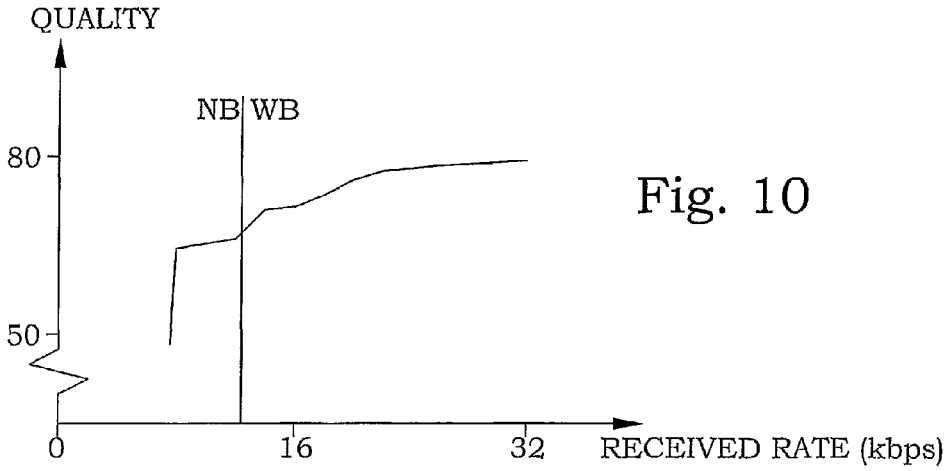
FIG. 10 is a diagram of an estimated degradation quality curve.

An estimated degradation quality curve based on initial qualification results for the up-coming standard is shown in FIG. 10. Estimated G.729.EV Performance (8(NB)/16(WB) kHz Mono) is illustrated.

In addition to the G.729.EV development ITU-T is planning to develop a new scalable codec with an 8 kbps Wideband core in Study Group 16 Question 9, and are as well discussing a new work item full auditory bandwidth codec while retaining some scalability features in Question 23.

If one re-writes the causal, non-causal and combination function as one operation, one can write the output, as $$\tilde{s}(n) = \sum_{i=-N^-}^{N^+} b_i \bar{s}^-(n+i) \tag{19}$$

Thus it can be seen that using optimal causal and non-causal predictors is similar to applying a double-sided filter to the primarily encoded signal. Double-sided filters have been applied to audio signals in different contexts. A pre-processing step using a smoothing utilizing forward and backward pitch extension is e.g. presented in the U.S. Pat. No. 6,738,739. However, the entire filter is applied in its whole at one and the same occasion, which means that a time delay is introduced. Furthermore, the filter is used for smoothing purposes, in the encoder, and is not involved in the actual prediction procedures.

In the European patent application EP 0 532 225, a method for treating a signal is disclosed. The method involves coding frames, preferably not exceeding 5 milliseconds, of input signal samples, preferably sampled at less than 16 Kilo-bits per secondary, with a coding delay preferably not exceeding 10 milliseconds. Each code-book vector having respective index signals is adjusted by a gain factor, preferably adjusted by backward adaptation, and applied to cascaded long-term and short-term filters to generate a synthesized candidate signal. The index corresponding to the candidate signal best approximating the associated frame and derived long-term filter, for example pitch, parameters are made available to subsequently decode the frame. Short term filter parameters are then derived by backward adaptation. Also here the entire filter is applied in one integral procedure and is applied to an already decoded signal, i.e. it is not applied in a prediction encoding or decoding process.

At the contrary, in the present invention, the operation described by eq. (19) is first divided in time, in that respect that a first preliminary result is achieved at one time by the primary encoder, and that improvements or enhancements are provided subsequently by the non-causal prediction encoder. This is the property which makes the operation suitable for layered audio coding. Furthermore, the operation is a part of a prediction encoding process and is therefore performed both on a "transmitting" side and a "receiver" side, or more generally at an encoding and a decoding side. Although EP 0

532 225 at a first glance may have some similarities with the present invention, the document concerns a completely different aspect.

Figure 6:
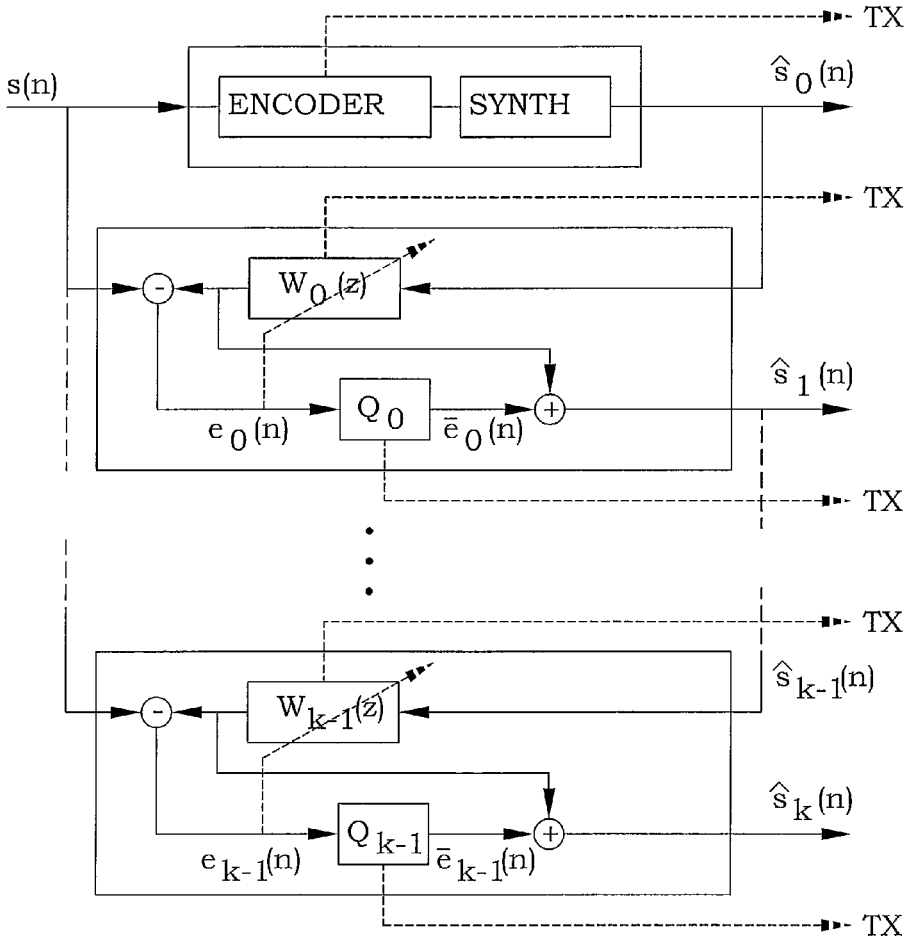
FIG. 6 is a schematic illustration of an enhancement of a primary encoder by using optimal filtering and quantization of residual parameters.

An embedded coding structure using the principle of this invention is depicted in FIG. 6. The figure illustrates enhancement of a primary encoder by using optimal filtering, whereby quantization of the residual (TX) parameters are transmitted to the decoder. This structure is based on the prediction of an original speech or audio signal s(n) based on the output of a "local synthesis" of a primary encoder. This is denoted $\hat{s}_0(n)$.

At each stage or enhancement layer, indexed by k, a filter $W_{k-1}(z)$ is derived and applied to a "local synthesis" of a previous layer signal $\tilde{s}_{k-1}(n)$, thus leading to a prediction signal $\tilde{s}_{k-1}(n)$. The filter could in a general be causal, non-causal or double sided, IIR or FIR. Hence no limitation of the filter type is made by this basic embodiment.

The filter is derived such that the prediction error:

$$e_{k-1}(n)=s(n)-\tilde{s}_k(n)=s(n)-W_{k-1}(z)\hat{s}_{k-1}(n) \tag{20}$$

is minimized with respect to some pre-determined fidelity criterion. The residual of the prediction is also quantized and encoded by a quantizer, $Q_{k-1}$ that may be layer dependent. This leads to a quantized prediction error:

$$\bar{e}_{k-1}(n)=Q_{k-1}(e_{k-1}(n)). \tag{21}$$

The latter is used to form a local synthesis of the current layer, which would be used for the next layer.

$$\hat{s}_k(n)=\bar{e}_{k-1}(n)+W_{k-1}(z)\hat{s}_{k-1}(n) \tag{22}$$

Parameters representative of the prediction filters $W_0(z)$, $W_1(z), \ldots, W_{k\ max}(z)$ and the quantizers $Q_0, Q_1, \ldots, Q_{k\ max}$ output indices are encoded and transmitted such that at the decoder side, these are used in order to decode the signal.

It should here be noted that by stripping the upper layers, decoding is still possible, however, at a lower quality that that obtained when decoding all layers.

With each additional layer, the local synthesis will come closer and closer to the original speech signal. The prediction filters will be close to the identity, while the prediction error will tend to zero.

In a generalization view, any of the signals $\hat{s}_0$ (n) to $\hat{s}_{k-1}(n)$ can be considered as a signal resulting from a primary encoding of the signal s(n) and a subsequent signal as an enhancement signal. The primary encoding my therefore in a general case not necessarily comprise of solely causal components, but may also comprise non-causal contributions.

This relationship between the filter and the prediction error can be efficiently used in order to jointly quantize and allocate bits for both the prediction filters and the quantizers. A prediction from a primary encoded speech is used in order to estimate the original speech. The residual of this prediction may also be encoded. This process may be repeated and thus providing a layered encoding of the speech signal.

The present invention utilizes this basic embodiment. According to the present invention a first layer comprises a causal filter, which is used to provide a first approximate signal. Furthermore, at least one of the additional layers comprises a non-causal filter, contributing to an enhancement of the decoded signal quality. This enhancement possibility is provided at a later stage, due to the non-causality and is provided in conjunction with a later causal filter encoding of a later signal sample. According to this embodiment of the present invention, non-causal prediction is used as means for embedded coding or layered coding. An additional layer thereby contains, among other things, parameters for forming non-causal prediction.

We have further above described prior art analysis by synthesis speech codecs. Also, FIG. 3 illustrates prior-art ideas behind the adaptive codebook paradigm that is used in current state-of-the-art speech codecs. Here below, it is presented how the present invention can be embodied in similar codecs by using an alternative implementation that is called the non-causal adaptive codebook paradigm.

Figure 7:
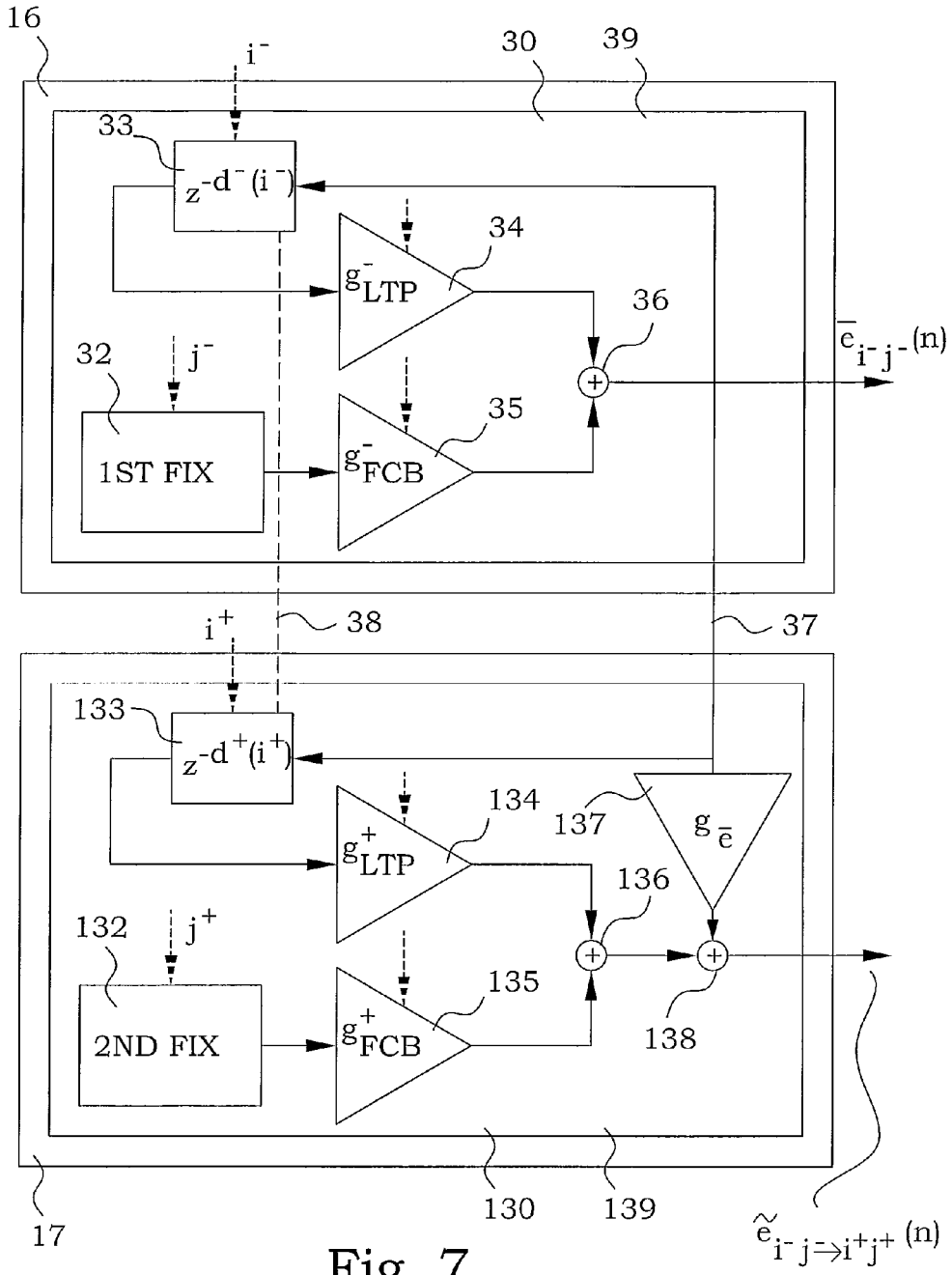
FIG. 7 is a block scheme of an embodiment utilizing a non-causal adaptive codebook paradigm.

FIG. 7 illustrates a presently preferred embodiment for a non-causal adaptive codebook. This codebook is based on the previously derived primary codebook excitation $\bar{e}_{ij}(n)$. The indices i and j relate to the entries of each of the codebooks.

A primary excitation codebook 39 utilizing a causal adaptive codebook approach is provided as a quantizer 30 of a causal prediction encoding section 16. The different parts are equivalent to what was described earlier in connection with FIG. 3. However, the different parameters are here provided with a "–" sign to emphasize that they are used in a causal prediction.

A secondary excitation codebook 139 utilizing a non-causal adaptive codebook approach is provided as a quantizer 130 of a non-causal prediction encoding section 17. The main parts of the secondary excitation codebook 139 are analogue to the primary excitation codebook 39. An adaptive codebook 133 and a fixed codebook 132 provides contributions having adaptive codebook gain $g^+_{LTP}$ 34 and fixed codebook gain $g^+_{FCB}$ 35, respectively. A composed excitation signal is derived in an adder 136.

The non-causal adaptive codebook 133 is furthermore based on the primary excitation codebook 39, illustrated by the connection 37. It uses the future samples of the adaptive codebook as entries and the output of this non-causal adaptive codebook 133 could be written as:

$$\tilde{e}_{ij\rightarrow k}(n)=\bar{e}_{ij}(n+d^+(k)) \tag{23}$$

The mapping function $d^+(\bullet)$ assigns the corresponding positive delay to each index that corresponds to backward, or non-causal, pitch prediction. The operation results in a non-causal LTP prediction.

The final excitation corresponds to a weighted linear combination of the primary excitation and the non-causal adaptive codebook contribution and possible a contribution from a secondary fixed codebook, $$\tilde{e}_{ij\rightarrow kl}(n)=g_{LTP}{}^+\bar{e}_{ij}(n+d^+(k))+g_{FCB}{}^+c_l(n)+g_{\bar{e}}\bar{e}_{ij}(n) \tag{24}$$

The primary excitation is therefore provided with a gain $g_{\bar{e}}$ 137 and added to the non-causal adaptive codebook 133 contribution and the contribution from the secondary fixed codebook 132 in an adder 138. Optimization and quantization of the gains and indices is such that a fidelity criterion is optimized.

Although only the construction of the codebook is described, it should be noted that the non-causal pitch delay might be fractional, thus benefiting from an increased resolution and hence leading to better performance. The situation is clearly the same as the one for causal pitch prediction. Here as well one could use multi-tap pitch predictors.

The non-causal prediction is here used in closed loop and is thus based on a primary encoding of the original speech signal. Since the primary encoding of the signal include causal prediction, some parameters that are characteristic of speech signals, such as the pitch delay, may be re-used, without extra cost in bit-rate, in order to form non-causal predictions.

In particular in the connection with adaptive codebook paradigms, it should be noted that often it is the case that one does not need to re-estimate the pitch, but to directly re-use the same pitch delay estimated for causal prediction. This is indicated as a dotted line 38 in FIG. 7. This leads to bit-rate savings without too much impact on the quality.

A refinement to this procedure consists of re-using only the integer pitch delay and then re-optimizing the fractional part of the pitch.

In general, even if the pitch delay is re-estimated, the complexity as well as the amount of bits needed to encode this variable is largely reduced if one takes into account that the non-causal pitch is very close to the causal pitch. Hence techniques such as differential encoding can efficiently be applied. On the complexity part, it should be clear that not all pitch ranges have to be searched. Only a few predetermined regions around the causal pitch may be searched. In summary, the mapping function $d^{+}(\bullet)$ can therefore made adaptively dependent on the primary pitch variable $d^{-}(i)$.

The principles of the non-causal adaptive codebook can be applied only if a certain amount of delay is available. In fact, samples of the future encoded excitation are needed in order to form the enhancement excitation.

Figure 8:
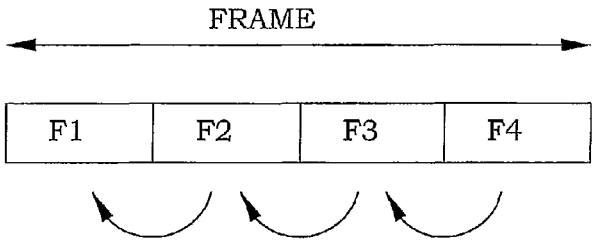
FIG. 8 is a schematic illustration of using non-causality within a single frame.

When the speech codec is operated on a frame-by-frame basis, a certain amount of look-a-head is available. The frame is usually divided into sub-frames. For example, after a primary encoding of a signal frame, the enhancement coder at the first sub-frame has access at the excitation samples of the whole frame without additional delay. If the non-causal pitch delay is relatively small, then encoding of the first sub frame by the enhancement coder may be done at no extra delay. This may also apply to the second, third frame as shown in FIG. 8, illustrating non-causal pitch prediction performed on a frame-by-frame basis. In this example, at the forth sub-frame, samples from the next frame may be needed, and would require an additional delay.

If no-delay is allowed, the non-causal adaptive codebook may still be used, however, it would not be activate for all sub-frames but only a few. Hence the number of bits used by the adaptive codebook would be variable. Signaling of active and inactive states can be implicit since the decoder upon reception of the pitch delay variables auto-detects if future signal samples are needed or not.

Several refinements of the above embodiments may be considered, such as smoothing an interpolation of the prediction filters parameters, use of weighted error measures and psycho-acoustical error measure. These refinements and others are well known principles for those skilled in the art and will not be detailed here.

Figure 9:
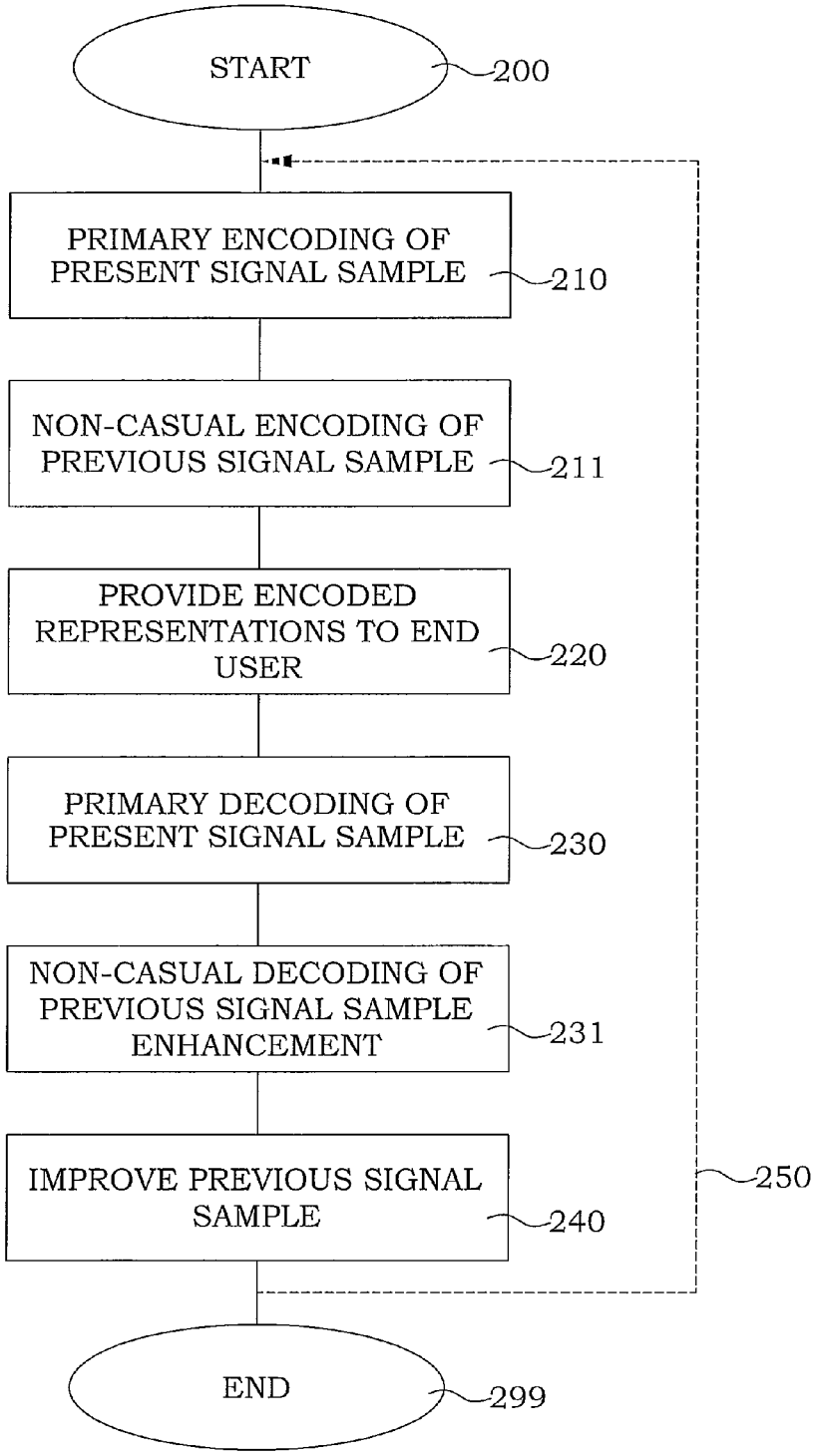
FIG. 9 is a flow diagram of steps of an embodiment of a method according to the present invention.

FIG. 9 illustrates a flow diagram of steps of an embodiment of a method according to the present invention. A method for audio coding and decoding starts in step 200. In step 210, a present audio signal sample is causal encoded into an encoded representation of the present audio signal sample. In step 211, a first previous audio signal sample is non-causal encoded into an encoded enhancement representation of the first previous audio signal sample. In step 220, the encoded representation of the present audio signal sample and the encoded enhancement representation of the first previous audio signal sample are provided to an end user. This step may be considered as composed by a step of providing, by an encoder, the encoded representation of the present audio signal sample and the encoded enhancement representation of the first previous audio signal sample and a step of obtaining, by a decoder, an encoded representation of a present audio signal sample and an encoded enhancement representation of a first previous audio signal sample at an end user. In step 230, the encoded representation of the present audio signal sample is causal decoded into a present received audio signal sample. In step 231, the encoded enhancement representation of the first previous audio signal sample is non-causal decoded into an enhancement first previous received audio signal sample. Finally, in step 240 a first previous received audio signal sample, corresponding to the first previous audio signal sample is improved based on the first previous received audio signal sample and the enhancement first previous received audio signal sample. The procedure ends in step 299. This procedure is basically repeated during an entire duration of an audio signal, as indicated by the broken arrow 250.

The present disclosure presents, among other things, an adaptive codebook characterized in using non-causal pitch contribution in order to form a non-causal adaptive codebook. Furthermore, an enhanced excitation is presented that is the combination of a primary encoded excitation and at least a non-causal adaptive codebook excitation. Also, an embedded speech codec is illustrated characterized in that each layer contains at least a prediction filter for forming a prediction signal, a quantizer, or encoder, for quantizing a prediction residual signal and means for forming a local synthesized enhanced signal. Similar means and functions are also provided for the decoder. Furthermore, variable-rate non-causal adaptive codebook formation with implicit signaling is described.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

REFERENCES

[1] U.S. Pat. No. 6,738,739.

[2] European patent application EP 0 532 225.

The invention claimed is:

1. A method for audio coding, comprising:

receiving a present audio signal sample;

sending the present audio signal sample to a causal encoding section;

encoding, by the causal encoding section, the present audio signal sample into an encoded representation of the present audio signal sample, wherein the encoded representation of the present audio signal sample is a causal prediction for the present audio signal sample based on at least one previously received audio signal sample;

encoding, by the non-causal encoding section, a previous audio signal sample into an encoded enhancement representation of the previous audio signal sample, wherein the previous audio signal is a signal sample from a point in time prior to the present audio signal sample, the non-causal encoding section encodes the previous audio signal sample based on information provided by the causal encoding section, the encoded enhancement representation of the previous audio signal sample is a non-causal prediction of the previous audio signal sample based on the information provided by the causal encoding section, and the information provided by the causal encoding section is information about the encoding of the present audio signal sample into an encoded representation of the present audio signal sample; and sending the encoded representation of the present audio signal sample and the encoded enhancement representation of the previous audio signal sample to a user.

2. The method for audio coding according to claim 1, further comprising:

combining the encoded representation of the present audio signal sample with the encoded enhancement representation of the previous audio signal sample into a combination signal.

3. The method for audio coding according to claim 2, further comprising minimizing resulting error between the encoded representation of the present audio signal sample and the combination signal.

4. The method for audio coding according to claim 3, wherein minimizing resulting error further comprises:

adding the resulting error to the encoded representation of the present audio signal sample so that the encoded representation of the present audio signal sample is as close as possible to the present audio signal sample with respect to a predetermined fidelity criterion.

5. The method for audio coding according to claim 1, wherein the causal prediction and the non-causal prediction are linear predictions.

6. The method for audio coding according to claim 1, wherein the causal prediction and the non-causal prediction are based on an adaptive codebook paradigm and the encoded representation of the present audio signal sample and the encoded enhancement representation of the previous audio signal sample comprise quantization indices of fixed and adaptive codebooks.

7. A method for audio decoding, comprising:

receiving an encoded representation of a present audio signal sample and an encoded enhancement representation of a previous audio signal sample;

decoding, using a causal decoding section, the encoded representation of the present audio signal sample into a received present audio signal sample;

decoding, using a non-causal decoding section, the encoded enhancement representation of the previous audio signal sample, into a received enhancement of the previous audio signal sample, wherein the previous audio signal sample is a signal sample from a point in time prior to the present audio signal sample, the received enhancement of the previous audio signal sample is a non-causal prediction of the previous audio signal based on information provided by the causal decoding section, and the information provided by the causal decoding section is information about the decoding of the received present audio signal sample from the encoded representation of the present audio signal sample; and combining the received present audio signal sample with the received enhancement of the previous signal sample.

8. An encoder, comprising:

at least one processor;

a non-transitory computer-readable storage medium comprising computer-readable instructions, when executed by the at least one processor, are configured to:

receive a present audio signal sample;

send the present audio signal sample to a causal encoding section, encode, by the causal encoding section, the present audio signal sample into an encoded representation of the present audio signal sample, wherein the encoded representation of the present audio signal sample is a causal prediction for the present audio signal sample based on at least one previously received audio signal sample;

encode, by the non-causal encoding section, a previous audio signal sample into an encoded enhancement representation of the previous audio signal sample, wherein the previous audio signal is a signal sample from a point in time prior to the present audio signal sample, the non-causal encoding section encodes the previous audio signal sample based on information provided by the causal encoding section, the encoded enhancement representation of the previous audio signal sample is a non-causal prediction of the previous audio signal sample based on the information provided by the causal encoding section, and the information provided by the causal encoding section is information about the encoding of the present audio signal sample into an encoded representation of the present audio signal sample; and send the encoded representation of the present audio signal sample and the encoded enhancement representation of the previous audio signal sample to a user.

9. The encoder according to claim 8, wherein the computer-readable instructions, when executed by the at least one processor, is further configured to:

combine the encoded representation of the present audio signal sample with the encoded enhancement representation of the previous audio signal sample into a combination signal.

10. The encoder according to claim 9, wherein the computer-readable instructions, when executed by the at least one processor, is further configured to:

minimize resulting error between the encoded representation of the present audio signal sample and the combination signal.

11. The encoder according to claim 10, wherein the computer-readable instructions, when executed by the at least one processor, is further configured to:

add the resulting error to the encoded representation of the present audio signal sample so that the encoded representation of the present audio signal sample is as close as possible to the present audio signal sample with respect to a predetermined fidelity criterion.

12. The encoder according to claim 8, wherein the causal prediction and the non-causal prediction are linear predictions.

13. The encoder according to claim 8, wherein the causal prediction and the non-causal prediction are based on an adaptive codebook paradigm and the encoded representation of the present audio signal sample and the encoded enhancement representation of the previous audio signal sample comprise quantization indices of fixed and adaptive codebooks.

14. A decoder, comprising:

at least one processor;

a non-transitory computer-readable storage medium comprising computer-readable instructions, when executed by the at least one processor, are configured to:

receive an encoded representation of a present audio signal sample and an encoded enhancement representation of a previous audio signal sample;

decode, using a causal decoding section, the encoded representation of the present audio signal sample into a received present audio signal sample;

decode, using a non-causal decoding section, the encoded enhancement representation of the previous audio signal sample, into a received enhancement of the previous audio signal sample, wherein the previous audio signal sample is a signal sample from a point in time prior to the present audio signal sample, the received enhancement of the previous audio signal sample is a non-causal prediction of the previous audio signal based on information provided by the causal decoding section, and the information provided by the causal decoding section is information about the decoding of the received present audio signal sample from the encoded representation of the present audio signal sample; and combine the received present audio signal sample with the received enhancement of the previous signal sample.

* * * * *

UNITED STATES PATENT AND TRADEMARK OFFICE

CERTIFICATE OF CORRECTION

PATENT NO. : 8,781,842 B2
APPLICATION NO. : 12/281953
DATED : July 15, 2014
INVENTOR(S) : Taleb It is certified that error appears in the above-identified patent and that said Letters Patent is hereby corrected as shown below:

On the Title Page, in Item (54), and in the Specification, Column 1, Line 1, under "Title", delete "NON-CASUAL" and insert -- NON-CAUSAL --, therefor.

In The Drawings

In Fig. 9, Sheet 9 of 9, for Tag "231", in Line 1, delete "NON-CASUAL" and insert -- NON-CAUSAL --, therefor.

In The Claims

In Column 17, Line 8, in Claim 3, delete "comprising" and insert -- comprising: --, therefor.

Signed and Sealed this
Twenty-seventh Day of January, 2015

Michelle K. Lee

Michelle K. Lee
*Deputy Director of the United States Patent and Trademark Office*